US006943651B2

(12) United States Patent
Mukaiyama et al.

(10) Patent No.: US 6,943,651 B2
(45) Date of Patent: Sep. 13, 2005

(54) DIELECTRIC RESONATOR DEVICE, HIGH FREQUENCY FILTER, AND HIGH FREQUENCY OSCILLATOR

(75) Inventors: Kazutaka Mukaiyama, Sagamihara (JP); Shigeyuki Mikami, Yokohama (JP); Hiroyasu Matsuzaki, Yokohama (JP); Tetsuya Kochi, deceased, late of Sagamihara (JP); by Kiyoharu Kochi, legal representative, Ehime-ken (JP); by Akiko Kochi, legal representative, Ehime-ken (JP); Takahiro Baba, Yokohama (JP); Koichi Sakamoto, Yokohama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/417,241

(22) Filed: Apr. 17, 2003

(65) Prior Publication Data

US 2004/0021531 A1 Feb. 5, 2004

(30) Foreign Application Priority Data

Apr. 17, 2002 (JP) ..... 2002-115144

(51) Int. Cl.[7] ..... H01P 7/10
(52) U.S. Cl. ..... 333/219.1; 333/204; 333/134
(58) Field of Search ..... 333/202, 204, 333/219, 219.1, 227, 238, 134, 246; 331/107 DP, 107 SL, 117 D

(56) References Cited

U.S. PATENT DOCUMENTS 5,700,745 A * 12/1997 Okuyama et al. ..... 501/134
5,786,740 A * 7/1998 Ishikawa et al. ..... 333/219.1
5,945,894 A * 8/1999 Ishikawa et al. ..... 333/202
6,069,543 A * 5/2000 Ishikawa et al. ..... 333/219.1
6,087,910 A * 7/2000 Matsumoto et al. ..... 333/202
6,172,572 B1 * 1/2001 Kajikawa et al. ..... 331/96
6,175,286 B1 * 1/2001 Ueno ..... 333/219.1
6,204,739 B1 * 3/2001 Sakamoto et al. ..... 333/219.1
6,278,344 B1 * 8/2001 Kurisu et al. ..... 333/219.1
6,331,808 B2 * 12/2001 Mikami et al. ..... 333/134
6,411,181 B1 * 6/2002 Ishikawa et al. ..... 333/219
6,556,107 B2 * 4/2003 Ishikawa et al. ..... 333/202

FOREIGN PATENT DOCUMENTS

| | | |
|---|---|---|
| EP | 0 764 996 A1 | 3/1997 |
| EP | 1 018 776 A2 | 7/2000 |
| FR | 2 778 025 | 10/1999 |
| JP | 11-239021 | 8/1999 |

OTHER PUBLICATIONS

Copy of European Search Report dated Jul. 18, 2003.
Copy of Korean Office Action dated Jan. 25, 2005 (and English translation of same).

* cited by examiner

*Primary Examiner*—Tuan T. Lam
*Assistant Examiner*—Hai L. Nguyen
(74) *Attorney, Agent, or Firm*—Dickstein, Shapiro, Morin & Oshinsky, LLP

(57) ABSTRACT

A dielectric resonator device includes a dielectric substrate. Electrode films are formed on the front and back surfaces of the dielectric substrate, respectively. A TE010-mode resonator is constituted by two circular openings which oppose each other and which are formed in the electrode films. Two opposing slots formed in the electrode films constitute a planar dielectric transmission line (PDTL). The PDTL is connected to the TE010-mode resonator. An excitation section is formed by extending two portions of each electrode film on two side of each slot into each opening.

14 Claims, 19 Drawing Sheets

DIELECTRIC RESONATOR DEVICE, HIGH FREQUENCY FILTER, AND HIGH FREQUENCY OSCILLATOR

BACKGROUND OF THE INVENTION

1. Field of the Invention

The present invention relates to a dielectric resonator device, a high frequency filter, and a high frequency oscillator which are suitable for use in high frequency electromagnetic waves (high frequency signals) such as microwaves and millimetriwaves.

2. Description of the Related Art

In general, a dielectric resonator device is known (e.g., Japanese Unexamined Patent Application Publication No. 11-239021, etc.) in which electrode films are provided on the front and back surfaces of a dielectric substrate, and a TE010-mode resonator is constituted by circular openings formed on the front and back surfaces of the dielectric substrate so as to oppose each other, with the dielectric substrate provided therebetween, and in which the front surface of the dielectric substrate is provided with a coplanar line connected to the TE010-mode resonator.

In this example of the related art, a strip central conductor of the coplanar line which is provided between grounded conductors (the electrode films) is extended into the circular openings of the TE010-mode resonator. This uses the extended central conductor as a coupling line, thus strongly coupling the coplanar line and the TE010-mode resonator.

In addition, another dielectric resonator device of the related art is also known in which a slot resonator with a grounded conductor is formed by a rectangular opening formed in an electrode film on the front surface of a dielectric substrate and a back surface's electrode film used as a grounded conductor, and in which a slot line composed of a groove is formed in the electrode film on the front surface and the slot line is connected to a rectangular slot resonator.

In the above dielectric resonator device of the related art, the mode of exciting and transmitting a high frequency signal differs among the TE010-mode resonator, the slot resonator, and the coplanar line. Accordingly, when strong coupling is established between the TE010-mode resonator or the like and the coplanar line, a problem occurs in that no load Q ($Q_0$) of the resonator deteriorates, thus increasing the loss.

In the other dielectric resonator device of the related art, in both the slot resonator and the slot line, a high frequency signal is excited and transmitted in the TE mode. Thus, deterioration in $Q_0$ caused by mode difference can be prevented. Although the electrode film in the contour portion (the periphery of the rectangular opening) of the slot resonator forms a short-circuited face, a leading end of the slot line is directly connected to the short-circuited face. Thus, electric field intensity at the leading end of the slot line cannot be increased, so that strong coupling between the slot resonator and the slot line cannot be obtained.

SUMMARY OF THE INVENTION

The present invention is made in view of the above problems in the related art. It is an object of the present invention to provide a dielectric resonator device, a high frequency filter, and a high frequency oscillator in which strong coupling between a resonator and a slot line or the like can be obtained.

To solve the above problems, the present invention is applied to a dielectric resonator device including a resonator which includes a dielectric substrate, an electrode film provided on a front surface between the two surfaces of the dielectric substrate, an opening formed in the electrode film, and a slot line having a slot connected to the opening of the resonator.

According to an aspect of the present invention, a dielectric resonator device is provided which includes a dielectric substrate composed of dielectric material, an electrode film formed by a conductor provided on at least a surface between the two surfaces of the dielectric substrate, a resonator including an opening formed in the electrode film, and a slot line having a slot formed in the electrode film, the slot being connected to the opening. The electrode film includes an excitation section formed by extending two portions of the electrode film on two sides of the slot into the opening.

According to the present invention, an excitation section can extend a slot into an opening of a resonator, and the excitation section can be disposed in a position in the opening of the resonator in which electric field intensity is strong. Accordingly, by inputting a high frequency signal having strong electric field intensity, for example, to a leading end (projecting end) of the excitation section, the resonator can be strongly excited, so that the coupling between the resonator and the slot line can be strengthened. Also, since each of the resonant mode of the resonator and the transmission mode of the slot resonator can be set to the TE mode, deterioration of no load Q of the resonator can be suppressed. Moreover, provision of the excitation section in the opening of the resonator can reduce the size of the entire device compared with the case of providing the excitation section outside the resonator.

Preferably, the length of the excitation section which is formed by the extension is set to substantially a value between $\lambda g/4$ and $(3\times\lambda g)/4$, where $\lambda g$ represents the wavelength of a high frequency signal used in the dielectric substrate.

According to the present invention, a position in the resonator in which the electric field is the maximum can be made close to a leading end of the excitation section which is a virtual open end. Thus, the coupling between the resonator and the slot line can be further strengthened.

A transmission line for transmitting a high frequency signal may be provided on the dielectric substrate, the slot line may form a T-branch line which branches from the transmission line in a T-form, and the excitation section may be disposed at a leading end of the T-branch line.

According to the present invention, among high frequency signals transmitted through the transmission line, a signal corresponding to the resonant frequency is reflected by the resonator. Thus, a band-reflecting filter can be formed.

The length of the T-branch line may be set to substantially a value of $\lambda g/4$, where $\lambda g$ represents the wavelength of the high frequency signal used in the dielectric substrate.

According to the present invention, the leading end of the excitation section, which is formed by extension, at a leading end of the T-branch line, can be used as a virtual open end. Thus, the leading end of the excitation section can be disposed in a position in which electric field is strong in the resonator, so that the coupling between the resonator and the slot line can be further strengthened.

According to another aspect of the present invention, a high frequency filter is provided wherein the dielectric resonator device is used as at least one of an input unit and an output unit.

According to the present invention, the coupling between the resonator and the slot line in the dielectric resonator device can be strengthened, so that the frequency range of the high frequency filter using the dielectric resonator device can be expanded.

Preferably, the function of line conversion is established by connecting a slot line to the output unit, which is different from a slot line connected to the input.

According to the present invention, the function of line conversion can be built into the high frequency filter, thus making the high frequency filter highly functional. Also, compared with the case of providing a line converter separately from the high frequency filter, the line converter can be omitted, thus reducing the size of the entire device.

According to another aspect of the present invention, a high frequency oscillator is provided wherein the dielectric resonator device is used.

According to the present invention, the coupling between the resonator and the slot line in the dielectric resonator device can be strengthened, thus enabling a reduction in phase noise in the high frequency oscillator using the dielectric resonator device, an increase in frequency modulation width, and an increase in oscillating output.

DESCRPTION OF THE PREFERRED EMBODIMENTS

A dielectric resonator device, a high frequency filter, and high frequency oscillator according to embodiments of the present invention are described in detail with reference to the accompanying drawings.

Figure 1:
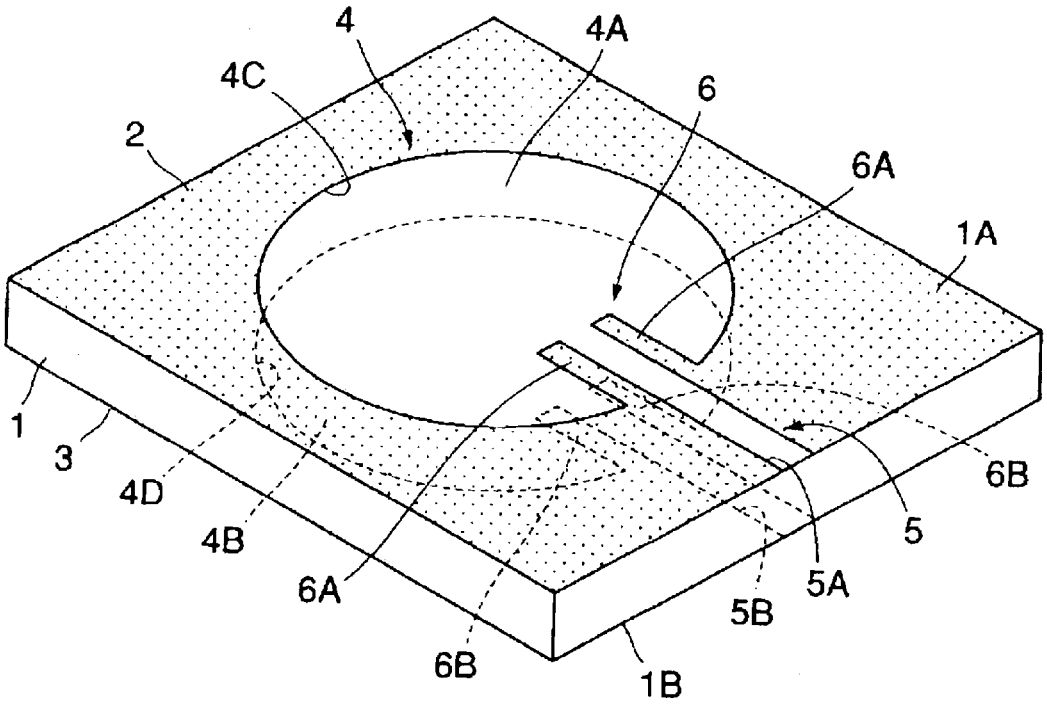
FIG. 1 is a perspective view showing a dielectric resonator device according to a first embodiment of the present invention.
Figure 2:
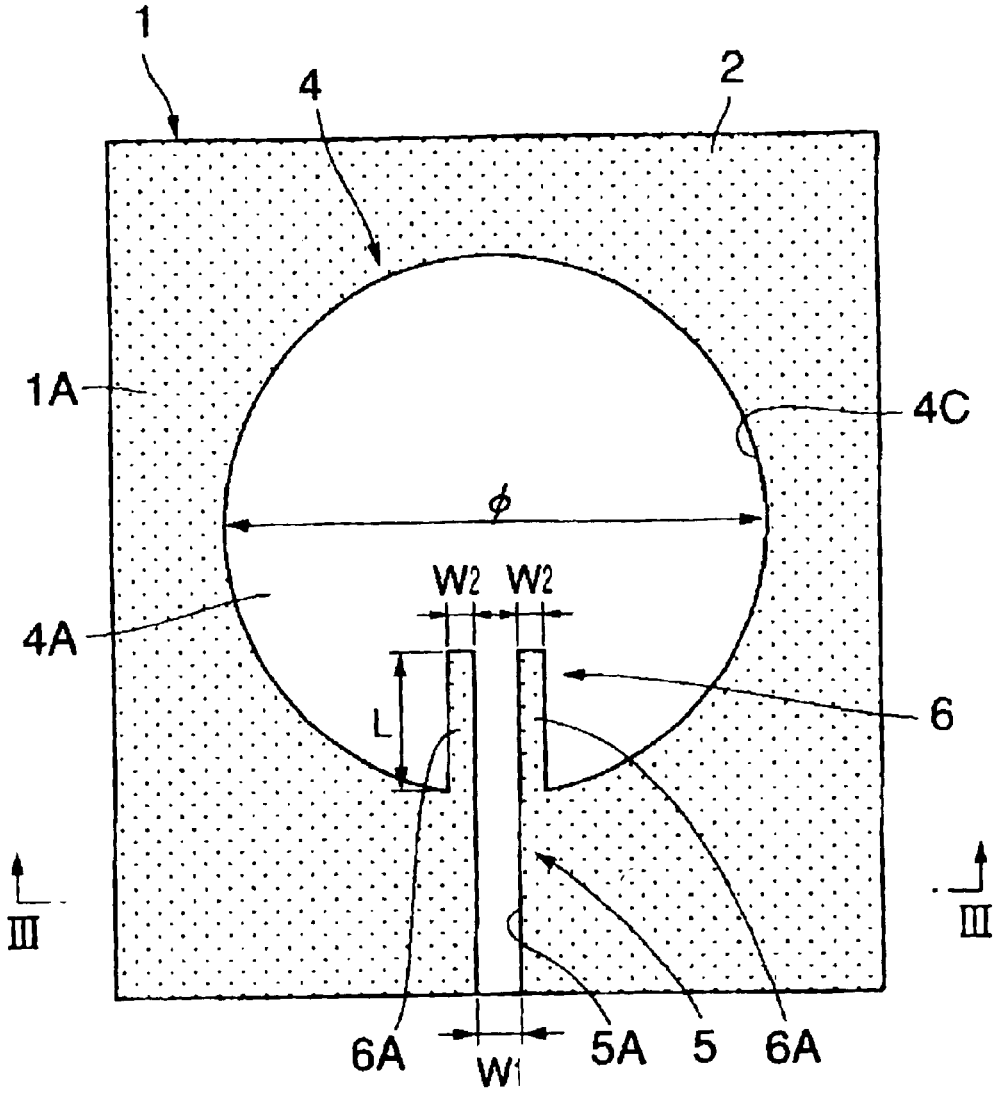
FIG. 2 is a plan view showing the dielectric resonator device according to the first embodiment.
Figure 3:
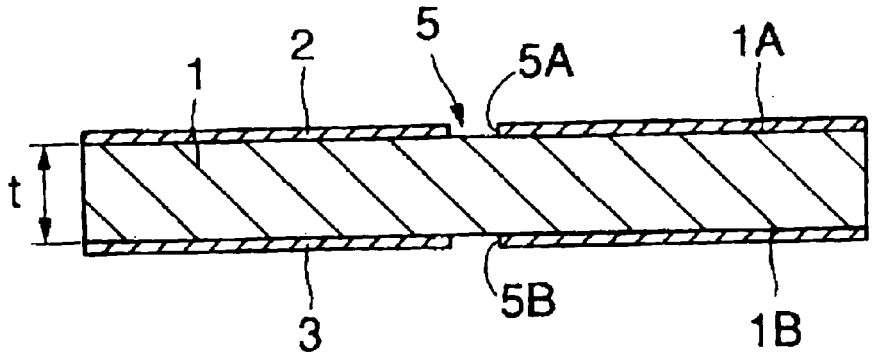
FIG. 3 is a sectional view showing a PDTL viewed from the direction of the arrows III—III shown in FIG. 2.
Figure 4:
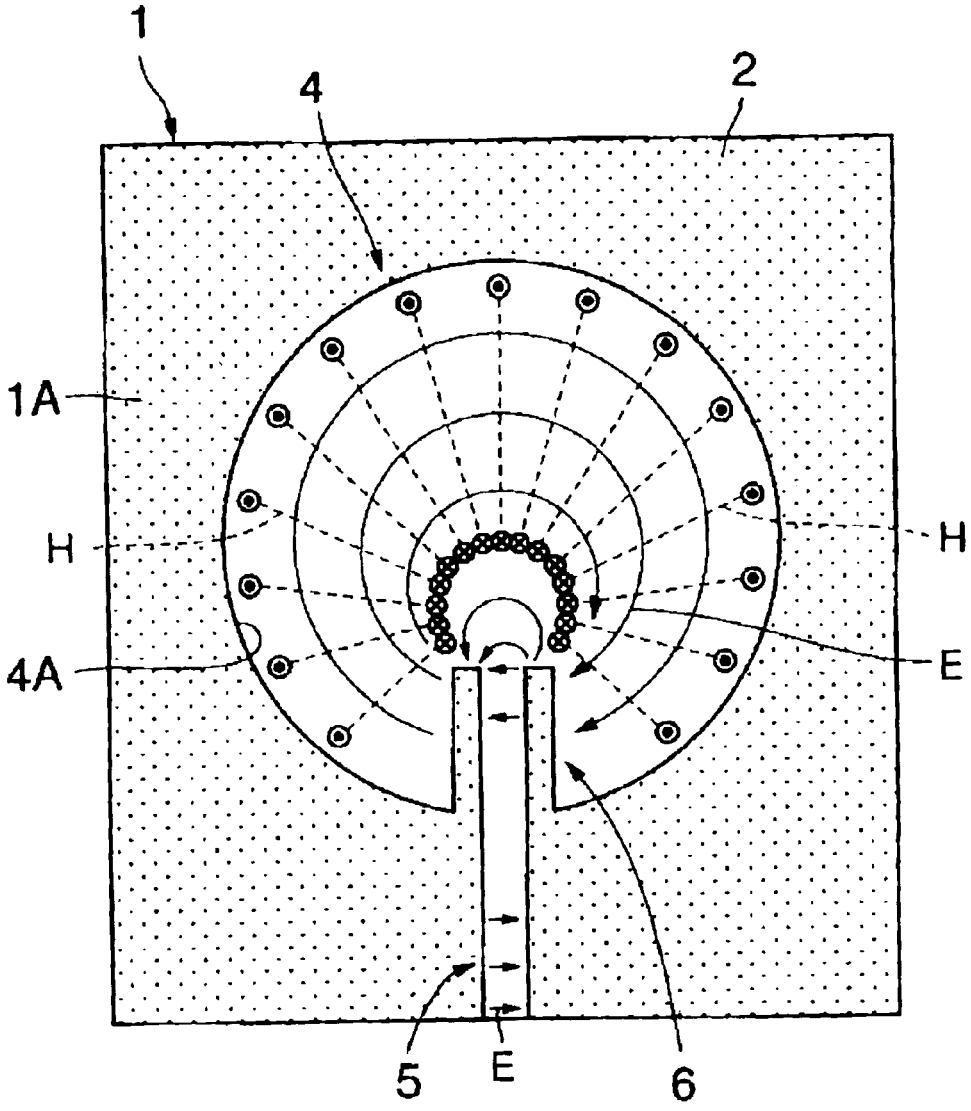
FIG. 4 is an illustration of a state in which a TE010-mode resonator excites.

FIGS. 1 to 3 show a dielectric resonator device according to a first embodiment of the present invention. In FIGS. 1 to 3, a dielectric substrate 1 has a substantially quadrangular planar shape. Dielectric material for the dielectric substrate 1 is resin material, ceramic material, or composite material formed by mixing the resin material and the ceramic material and burning the mixture. The dielectric substrate 1 has, for example, a thickness t set at 0.6 mm (t=0.6 mm) and relative dielectric constant $\in r$ set at approximately 24 ($\in r$=24).

The dielectric substrate 1 has electrode films 2 and 3 respectively formed on the front surface 1A and back surface 1B thereof. The electrode films 2 and 3 are formed by using, for example, lithography technology or the like to fine pattern both surfaces with conductive metal thin films of gold, silver, copper, etc.

A circular TE010-mode resonator 4 in the center of the dielectric substrate 1 is formed by circular openings 4A and 4B respectively formed on the electrode films 2 and 3. The circular openings 4A and 4B oppose each other, with the dielectric substrate 1 provided therebetween. In the TE010-mode resonator 4, its resonant frequency f0 is set to, for example, 300 GHz (f0=300 GHz), and its diameter $\phi$ is set to, for example, approximately 3.5 mm ($\phi$=3.5 mm), which is a value approximately equal to wavelength $\lambda g$ where $\lambda g$ represents the wavelength of a high frequency signal corresponding to the resonant frequency f0 in the dielectric substrate 1.

A planar dielectric transmission line 5 (hereinafter referred to as "PDTL 5") is a slot line linearly extending from a peripheral edge of the dielectric substrate 1 to the TE010-mode resonator 4. The PDTL 5 leads along the direction of a normal to the TE010-mode resonator 4, which is circular. The PDTL 5 is constituted by groove slots 5A and 5B respectively formed in the electrode films 2 and 3. The slots 5A and 5B are positioned opposing each other, with the dielectric substrate 1 provided therebetween. The PDTL 5 has, for example, a width W1 set to approximately 0.1 mm (W1=0.1 mm).

An excitation section 6 is provided in the openings 4A and 4B of the TE010-mode resonator 4. The excitation section 6 is positioned on a line extending from the PDTL 5 and leads to the center of the TE010-mode resonator 4. The excitation section 6 is provided on the front surface 1A of the dielectric substrate 1, projecting into the opening 4A. The excitation section 6 is constituted by two slender excitation lines 6A extending in parallel, and two slender excitation lines 6B positioned opposing the two excitation lines 6A so that the dielectric substrate 1 is provided therebetween. The excitation section 6 allows the PDTL 5 to lead into the TE010-mode resonator 4.

The excitation lines 6A are formed by extending, into the opening 4A, portions of the electrode film 2 which are positioned on two sides of the slot 5A. A conductive metal thin film identical to the electrode film 2 is used to integrate the excitation lines 6A with the electrode film 2. Similarly, the excitation lines 6B are also formed such that portions of the electrode film 3 which are positioned on two sides of the slot 5B are drawn into the opening 4B.

For the wavelength λg of the high frequency signal corresponding to resonant frequency f0 in the dielectric substrate 1, the length L by extension of the excitation section 6, which projects from the peripheries 4C and 4D of the openings 4A and 4B forming the contour of the TE010-mode resonator 4, is set to, for example, a value ($\lambda g/4 \leqq L \leqq (3\times\lambda g)/4$) between λg/4 and (3×λg)/4. The excitation lines 6A and 6B of the excitation section 6 are each set to have a width W2 of 0.1 mm (W2=0.1 mm).

The dielectric resonator device according to the embodiment of the present invention has the above-described structure, and its operation is described below with reference to FIGS. 1 to 5.

By inputting, to the PDTL 5, electromagnetic waves (high frequency signal) having, for example, a high frequency of approximately 300 GHz, an electric field E is generated in the width direction of each of the slots 5A and 5B, and a magnetic field H is generated in the width direction of each of the slots 5A and 5B and in the thickness direction of the dielectric substrate 1. The high frequency signal is transmitted to the TE010-mode resonator 4 in the form of transverse electric (TE) waves which are repeatedly reflected by all the front surface 1A and back surface 1B of the dielectric substrate 1. The high frequency signal is also emitted from the leading end of the excitation section 6 which is continuous from the PDTL 5, into the openings 4A and 4B of the TE010-mode resonator 4. At this time, the high frequency signal in the TE010-mode resonator 4 generates a ring electric field E and a torus-shape magnetic field H surrounding the ring electric field E because the circumferential surface between the peripheries 4C and 4D is short-circuited. The TE010-mode resonator 4 resonates in a resonant mode in accordance with the TE010-mode (see FIG. 4).

Accordingly, in this embodiment, the PDTL 5, through which a high frequency signal is transmitted in a mode identical to the resonant mode of the TE010-mode resonator 4, is connected to the TE010-mode resonator 4. Thus, compared with a case in which a coplanar transmission line is connected as in the related art, the present invention can prevent deterioration at no load Q ($Q_0$), thus suppressing the loss.

In addition, in a case in which the excitation section 6 is not provided as in another example in the related art, an end (open end) of the PDTL 5 touches the peripheries 4C and 4D forming the short-circuited surface. Thus, the electric field intensity of the end of the PDTL 5, which is an excitation member, cannot be enhanced. Conversely, in this embodiment, the leading end of the excitation section 6 is away from the peripheries 4C and 4D. Thus, the TE010-mode resonator 4 can be excited, with the electric field intensity of the leading end of the excitation section 6 enhanced. This can enhance the coupling between the TE010-mode resonator 4 and the PDTL 5.

In particular, in the TE010-mode resonator 4, the centers of the openings 4A and 4B and a ring portion positioned in the middle of the peripheries 4C and 4D have enhanced electric field intensities. Also, in the excitation section 6, the two excitation lines 6A are insulated from each other, and the two excitation lines 6B are insulated from each other, so that the leading end of the excitation section 6 is a virtual open end having large electric field intensity. The excitation section 6 projects from the peripheries 4C and 4D to a position in which the TE010-mode resonator 4 has a strong electric field. Thus, the virtual open end of the excitation section 6 can be disposed in a position in which the TE010-mode resonator 4 has a strong electric field. Thus, the TE010-mode resonator 4, has an enhanced electric field intensity enhanced.

Figure 5:
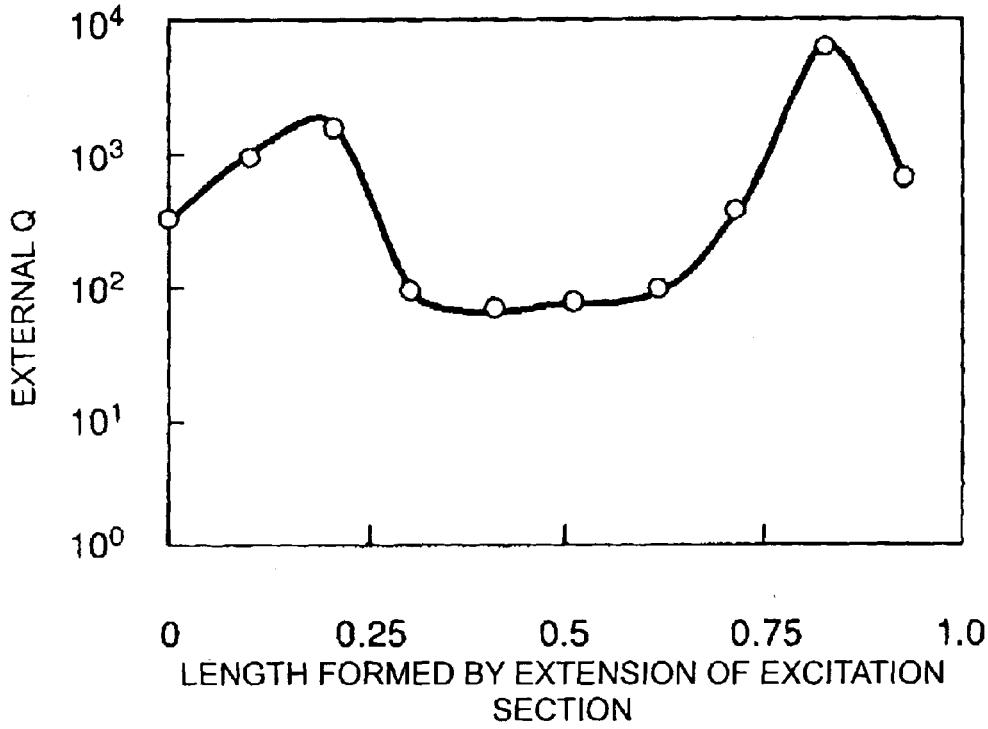
FIG. 5 is a graph showing a relationship between the length by extension of an excitation section and the external Q (Qe) of the TE010-mode resonator.

The analysis results shown in FIG. 5 can be obtained by performing electromagnetic simulation by, for example, setting the relative dielectric constant εr of the dielectric substrate 1 to 24, setting the thickness t of the dielectric substrate 1 to 0.6 mm, setting the diameter ϕ of the TE010-mode resonator 4 to 3.5 mm, setting the width W1 of the PDTL 5 to 0.1 mm, and setting each width W2 of the excitation lines 6A and 6B of the excitation section 6 to 0.1 mm.

FIG. 5 shows a relationship between the length L of the excitation section 6 and the external Q (Qc) of the TE010-mode resonator 4. In FIG. 5, the position of L=0 indicates a state (state in which the excitation section 6 is not provided) similar to that in the example of the related art. Qc in this state is approximately 300. Conversely, by allowing the excitation section 6 to project into the TE010-mode resonator 4, Qe can be enhanced to approximately 70.

In particular, the range ($\lambda g/4 \leqq L \leqq (3\times\lambda g)/4$) in which the length L of the excitation section 6 is between λg/4 and (3×λg)/4, which is a range in which a position in which the electric field of the TE010-mode resonator 4 is the maximum is close to the virtual open end (leading end) of the excitation section 6, has Qe smaller than that in another range. Therefore, as in this embodiment, by setting the length L of the excitation section 6 between λg/4 and (3×λg)/4, the coupling between the TE010-mode resonator 4 and the PDTL 5 can be further strengthened.

In addition, since the excitation section 6 is formed inside the TE010-mode resonator 4, the formation of the excitation section 6 does not enlarge the entire device. Moreover, since the same electrode film process is used to form the TE010-mode resonator 4, the PDTL 5, and the excitation section 6, a dielectric resonator device having small differences in characteristics can be provided.

In the first embodiment, the TE010-mode resonator 4 is used as a resonator. However, the present invention is not limited thereto. In the present invention, a circular resonator in which an electrode film 2 having a circular opening is formed on the front surface of the dielectric substrate 1, and the electrode film 3 on the back surface 1B is omitted, may be used as a resonator. Also, a circular resonator may be used in which an electrode film 2 having a circular opening is formed on the front surface of the dielectric substrate 1 and a grounded electrode film 2 is formed on the entire back surface 1B.

In the first embodiment, the excitation lines 6A and 6B of the excitation section 6 are linear. However, the present invention is not limited thereto. The present invention may employ various shapes as shown in the first to sixth modifications shown in FIGS. 6 to 11.

Figure 6:
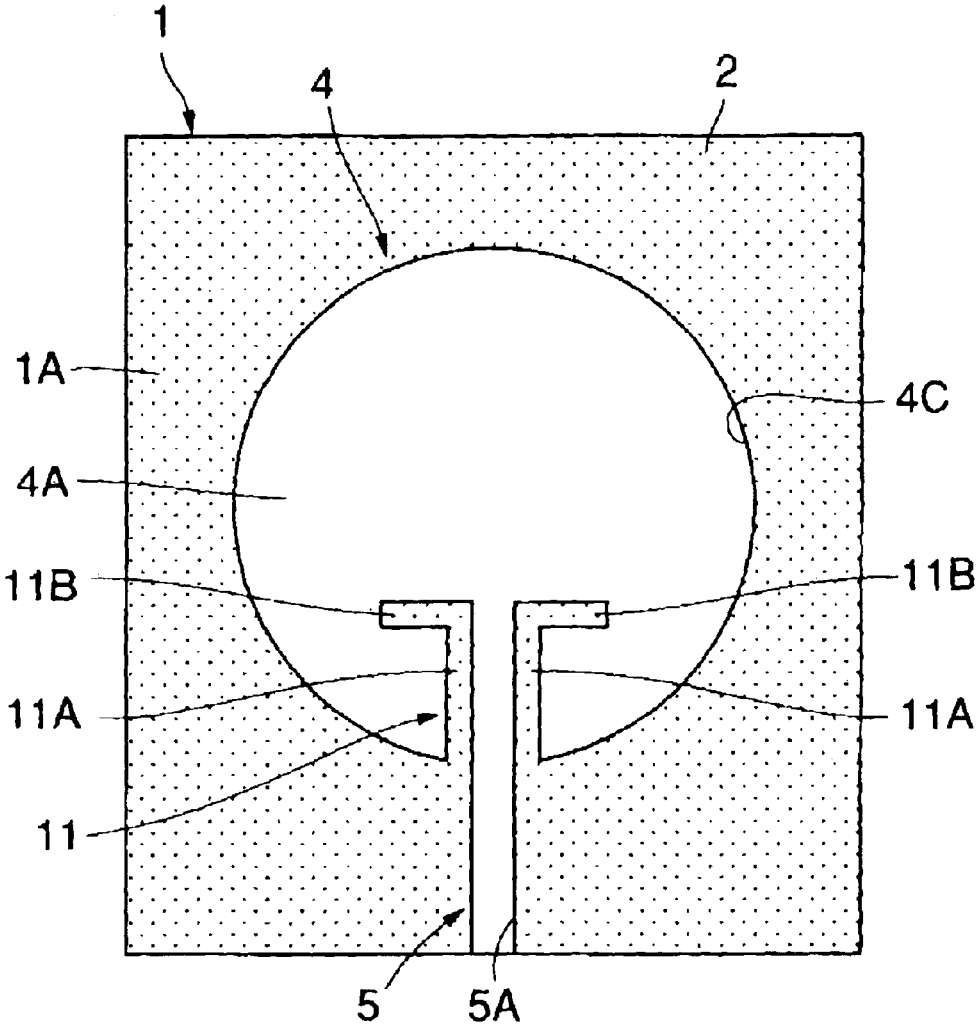
FIG. 6 is a plan view showing a dielectric resonator device according to a first modification of the present invention.

For example, as in the first modification in FIG. 6, bending portions 11B which bend in mutually distant directions may be formed at the ends of two excitation lines 11A (only the front surface 1A shown) constituting an excitation section 11. In this case, the bending portions 11B of the bending section 11 facilitate the generation of a ring electric field because the ends of the excitation section 11 are formed extended.

Figure 7:
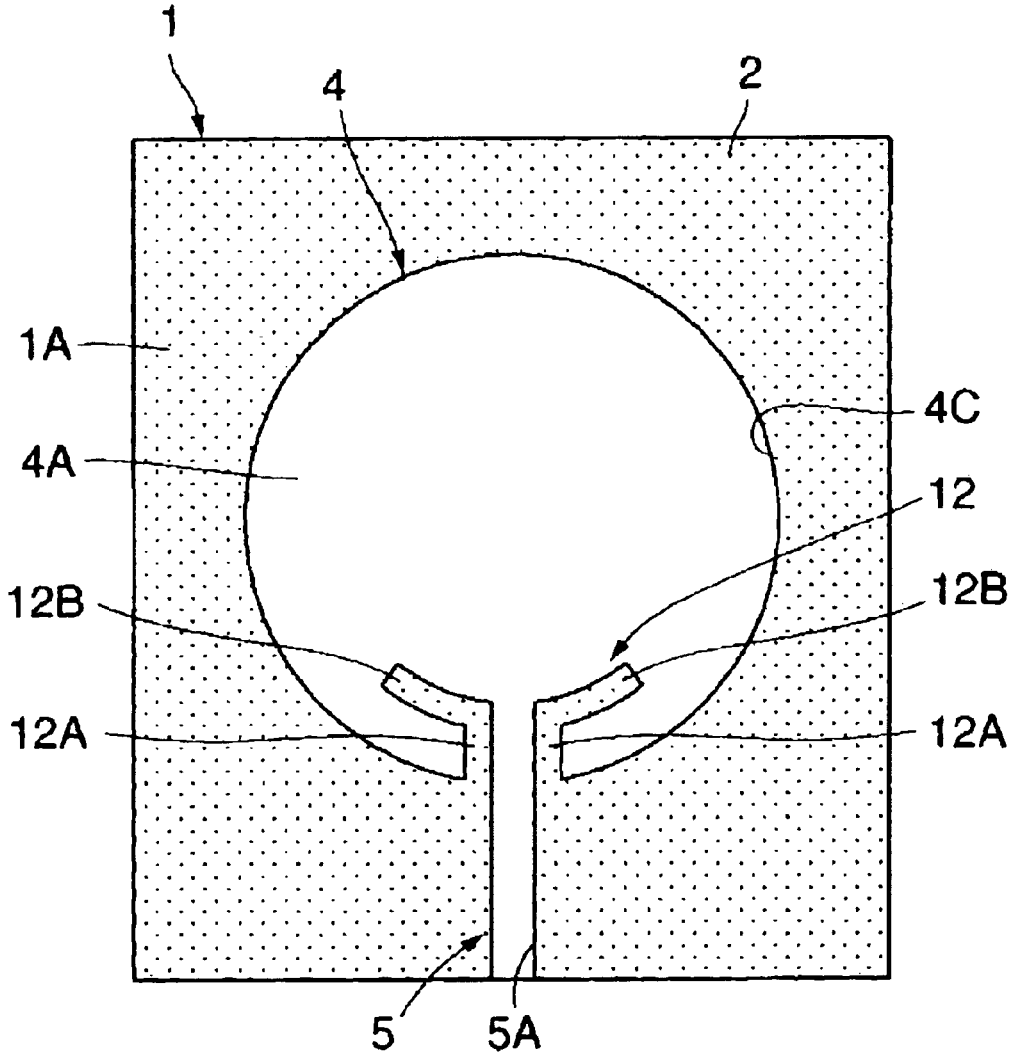
FIG. 7 is a plan view showing a dielectric resonator device according to a second modification of the present invention.

As in the second modification in FIG. 7, warping portions 12B which extend along a periphery 4C of the TE010-mode resonator 4 and which bend in mutually distant directions may be formed at the ends of two excitation lines 12A (only the front surface 1A is shown) constituting an excitation section 12. In this case, since the ends of the excitation lines 12 are warped along a periphery 4C, induction of a magnetic field surrounding the warping portions 12B and the generation of a torus-shape magnetic field in the TE010-mode resonator 4 are facilitated.

Figure 8:
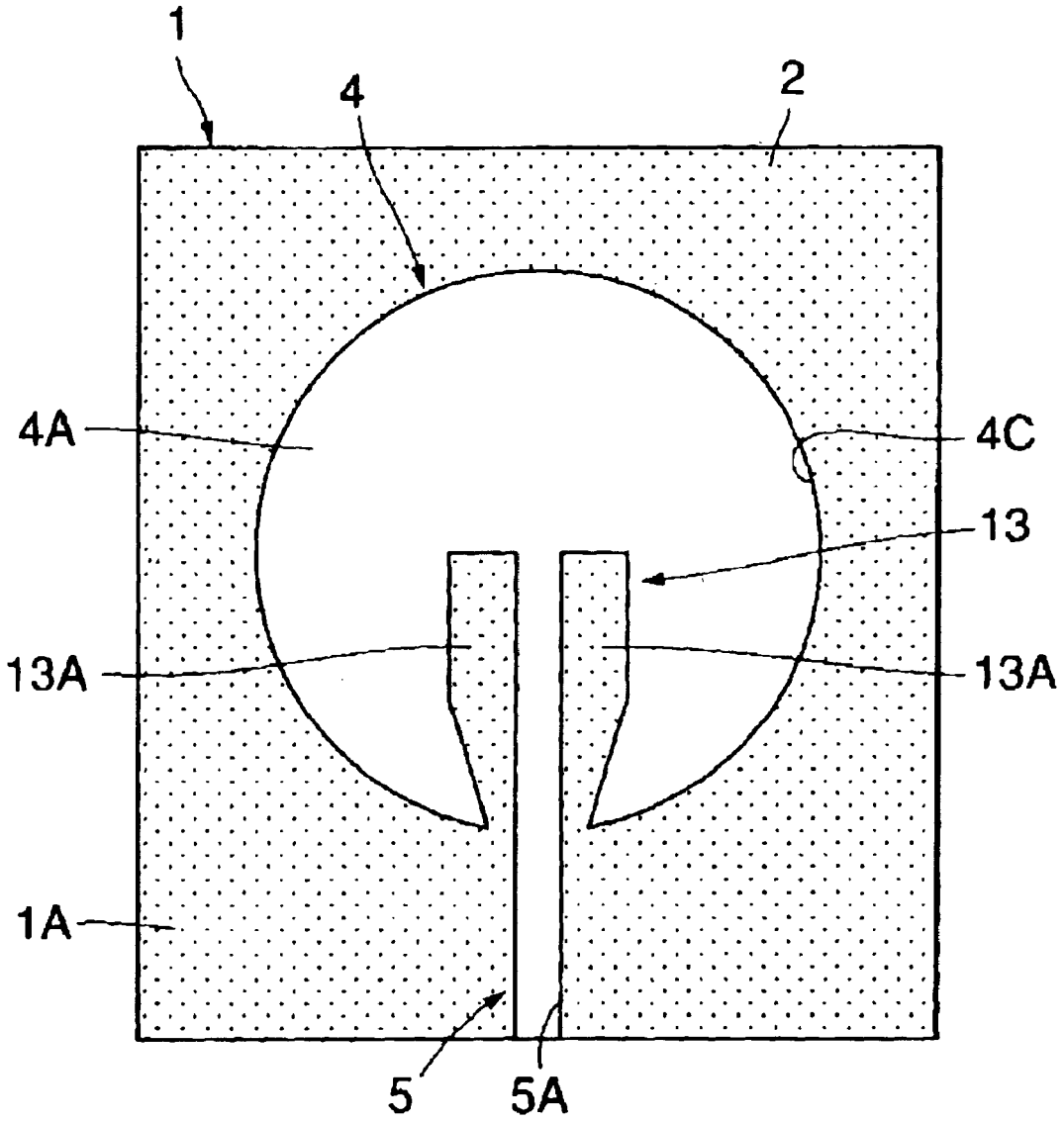
FIG. 8 is a plan view showing a dielectric resonator device according to a third modification of the present invention.
Figure 9:
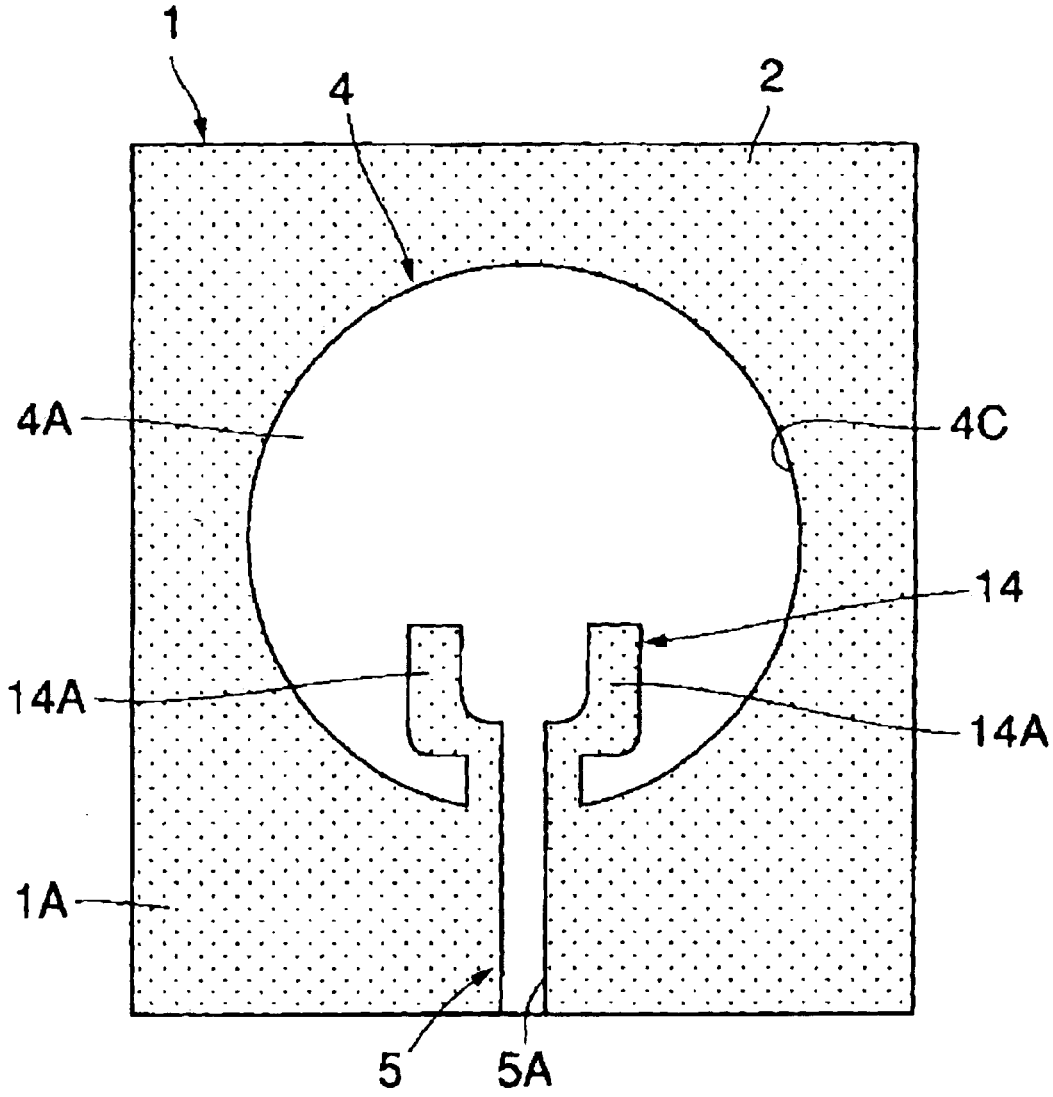
FIG. 9 is a plan view showing a dielectric resonator device according to a fourth modification of the present invention.

As in the third modification in FIG. 8, the width of each of excitation lines (only the front surface 1A is shown) 13A of an excitation section 13 may be set to different values between the base and leading ends (e.g., a larger value as the width of the end). Also, in the fourth modification in FIG. 9, the distance between two excitation lines 14A (only the front surface 1A is shown) constituting an excitation section 14 may be set to different values between the base and the end (e.g., a larger value as the distance between the ends).

In these cases, the impedances of the excitation sections 13 and 14 change in accordance with the width of the excitation line 13A and the distance between the excitation lines 14A. Thus, the external Q (Qe) of the TE010-mode resonator 4 can be adjusted.

Figure 10:
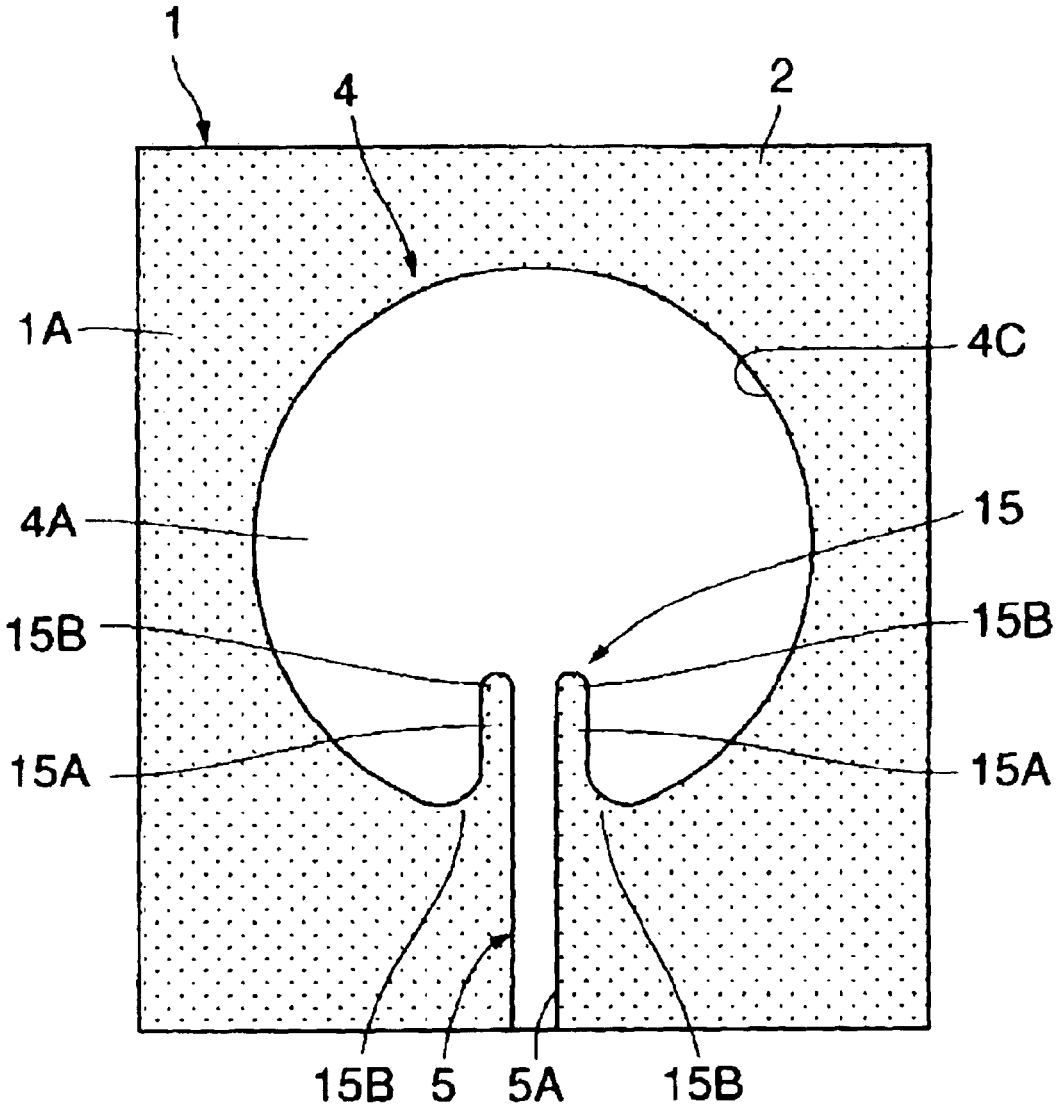
FIG. 10 is a plan view showing a dielectric resonator device according to a fifth modification of the present invention.

As in the fifth modification in FIG. 10, chamfers 15B which are continuous rounded portions may be formed by processing acute-angled portions on the bases and ends of in excitation lines 15A (only the front surface 1A shown) constituting an excitation section 15.

In this case, a current is easily concentrated on the acute-angled portions, so that the nonleaded Q ($Q_0$) of the TE010-mode resonator 4 tends to decrease. The chamfers 15B can relax the concentration of the current, so that deterioration in $Q_0$ can be suppressed.

Figure 11:
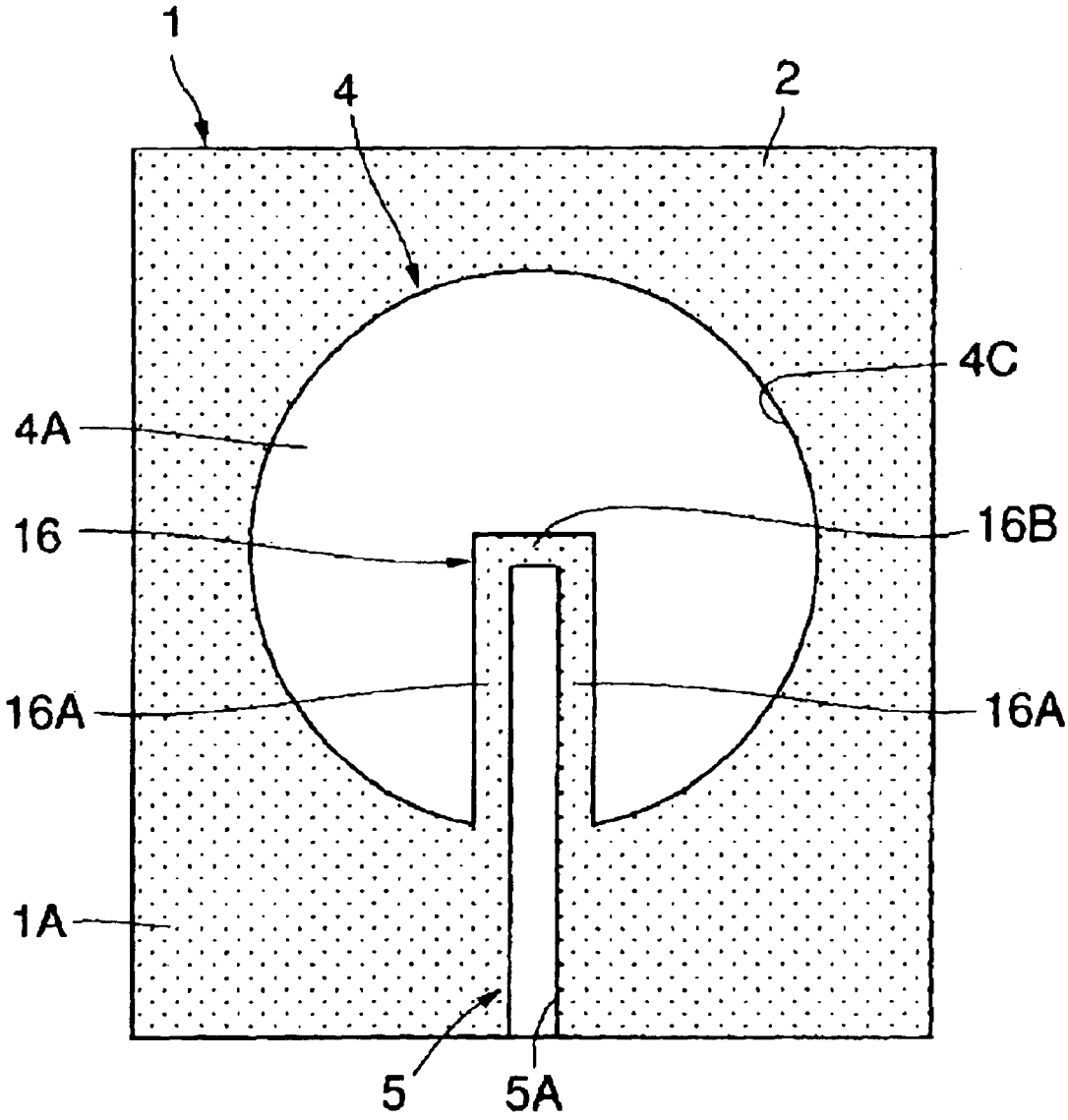
FIG. 11 is a plan view showing a dielectric resonator device according to a sixth modification of the present invention.

Although the first embodiment forms the ends of the excitation section 6 as open ends, as in the sixth modification in FIG. 11, the ends of an excitation section 16 may be formed as a short-circuited end 16B by connecting the ends of two excitation lines 16A (only the front surface 1A is shown) constituting the excitation section 16.

In this case, by disposing the short-circuited end 16B in a virtual short-circuited point (the central point) of the TE010-mode resonator 4, the coupling with the TE010-mode resonator 4 can be strengthened.

Figure 12:
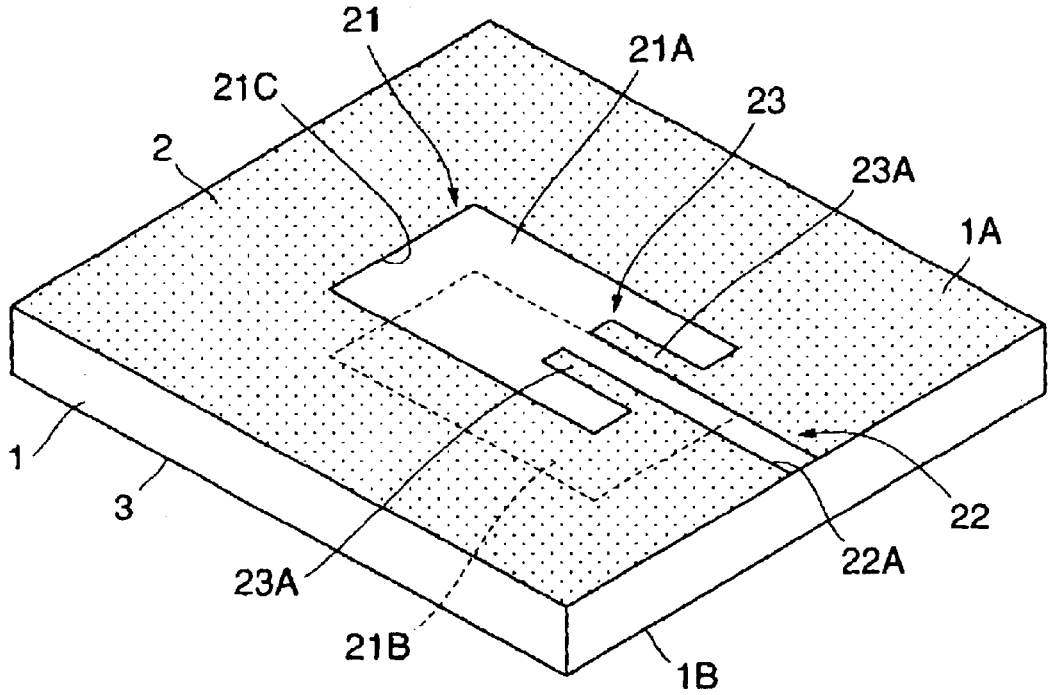
FIG. 12 is a perspective view showing a dielectric resonator device according to a second embodiment of the present invention.
Figure 13:
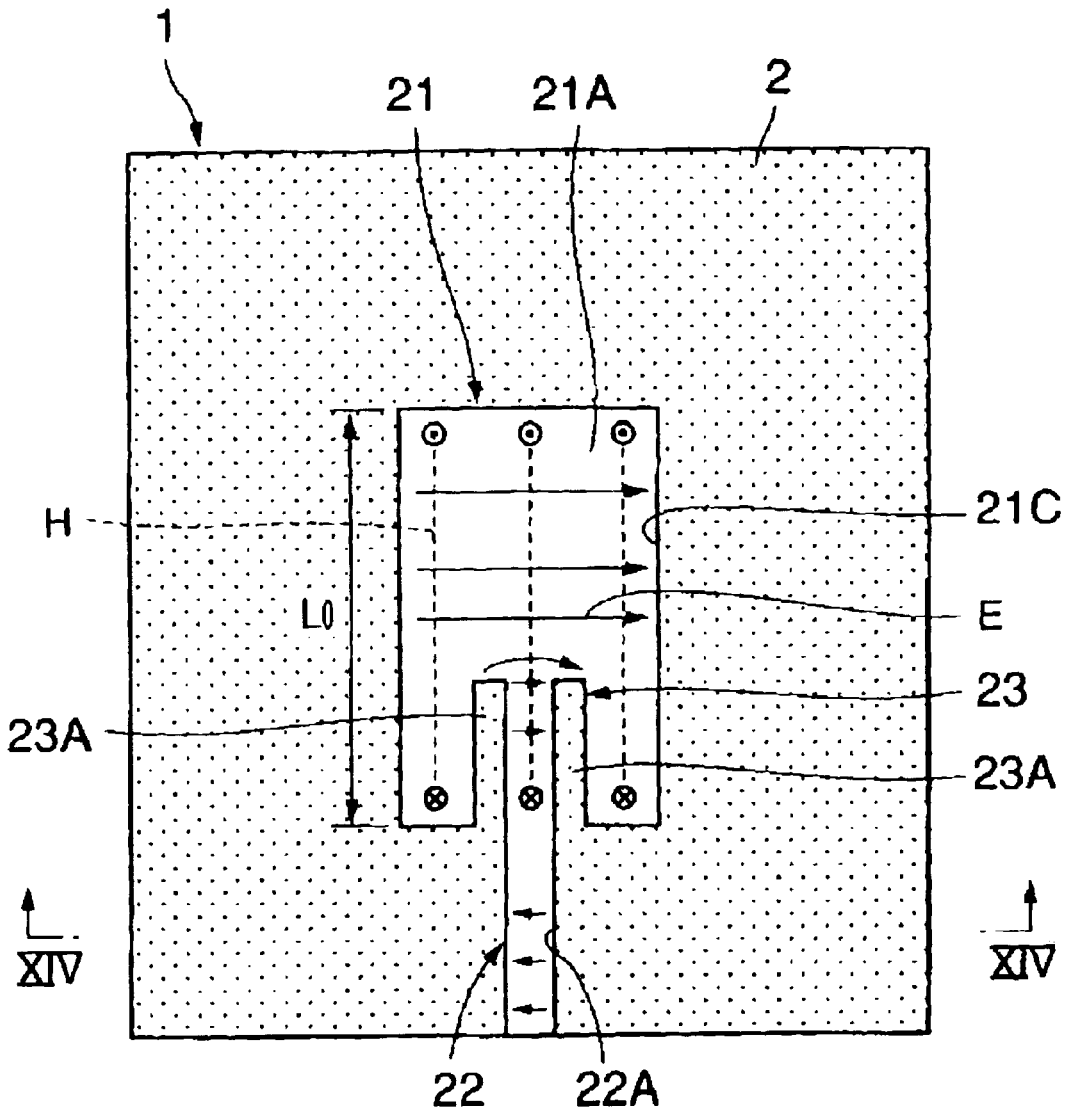
FIG. 13 is a plan view showing the dielectric resonator device according to the second embodiment.
Figure 14:
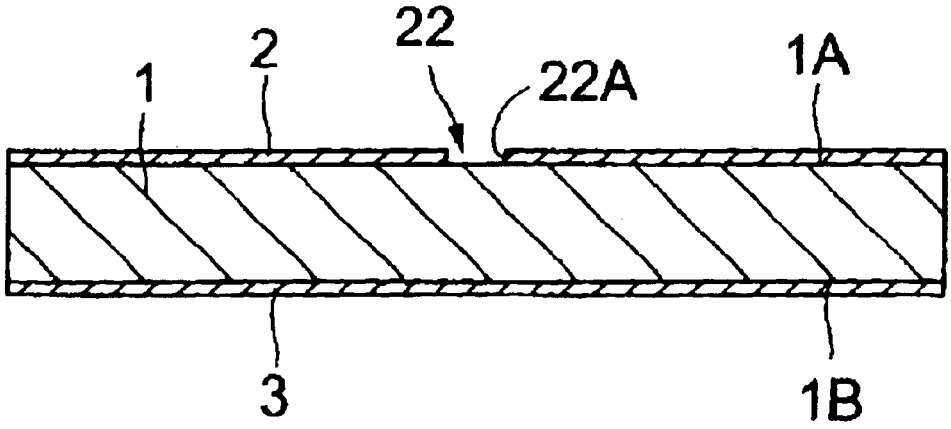
FIG. 14 is a sectional view showing a slot line with a grounded conductor which is viewed from the direction of the arrows XIV—XIV in FIG. 13.

FIGS. 12 to 14 show a dielectric resonator device according to a second embodiment of the present invention. The second embodiment is characterized in that a planar dielectric line resonator is used as a resonator and a slot line with a grounded conductor is used as a slot line. In the second embodiment, components identical to those in the first embodiment are denoted by identical reference numerals, and descriptions thereof are omitted.

A quadrangle PDTL resonator 21 is provided in the center of a dielectric substrate 1. The PDTL resonator 21 includes quadrangle openings 21A and 21B respectively formed on electrode films 2 and 3. The openings 21A and 21B oppose each other, with a dielectric substrate 1 provided therebetween. In the PDTL resonator 21, when the wavelength of a high frequency signal corresponding to resonant frequency f0 in the dielectric substrate 1 is represented by λg, a length L0 in the transmission direction of the high frequency signal is set to be approximately half (L0=λg/2) of wavelength λg.

A slot line 22 with a grounded conductor is a slot line and linearly leads from a peripheral edge to the PDTL resonator 21. The slot line 22 with the grounded conductor almost perpendicularly leads to one side of the quadrangle PDTL resonator 21. The slot line 22 is formed by a groove slot 22A formed in the electrode film 2.

An excitation section 23 is positioned in the opening 21A of the PDTL resonator 21. The excitation section 23 leads to the center of the PDTL resonator 21, lying on a line extending from the slot line 22. The excitation section 23 is positioned on the front surface 1A of the dielectric substrate 1, projecting from the periphery 21C of the opening 21A forming the contour of the PDTL resonator 21. The excitation section 23 consists of two slender excitation lines 23A extending in parallel.

The excitation lines 23A are formed in a form integrated with the electrode film 2 by drawing, into the opening 21A, two portions of the electrode film 2 which are positioned on two sides of the slot 22A, so that the slot line 22 is extended into the PDTL resonator 21.

The dielectric resonator device according to the second embodiment has the above-described structure. A TE-mode high frequency signal, transmitted through the slot line 22, is emitted from the end of the excitation section 23 into the PDTL resonator 21. This forms, in the PDTL resonator 21, an electric field E almost parallel to the width direction of the slot 22A and a magnetic field H surrounding the electric field E. The high frequency signal resonates, forming the TE mode.

Accordingly, also in the second embodiment, operation and advantages similar to those in the first embodiment can be obtained.

Figure 15:
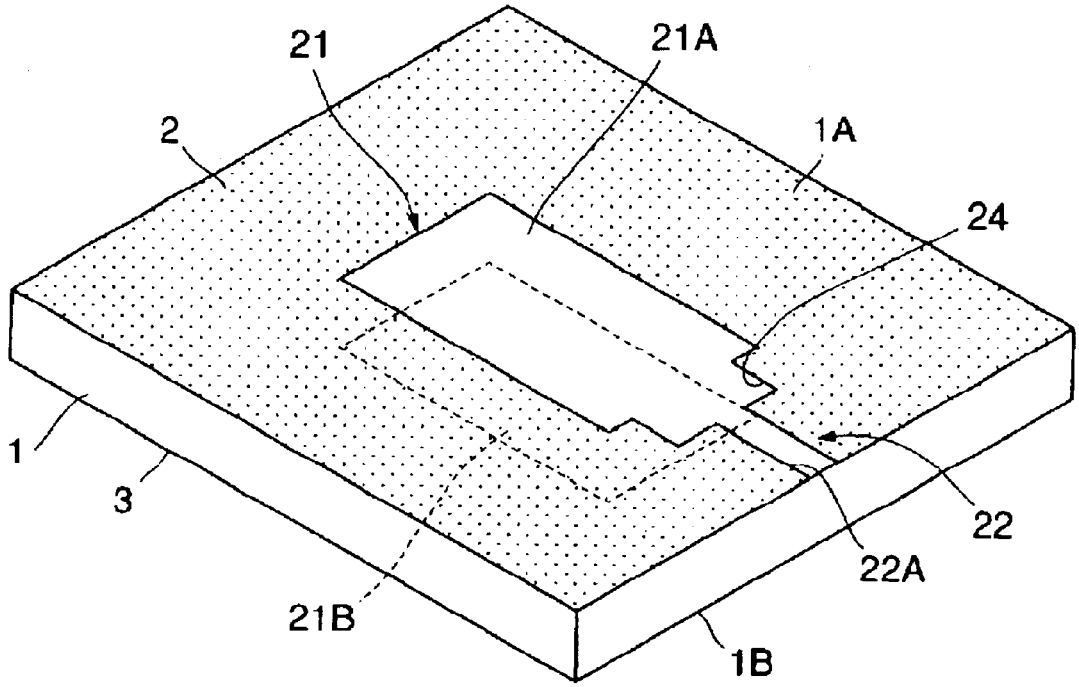
FIG. 15 is a perspective view showing a dielectric resonator device according to a comparative example.

In the case of the PDTL resonator 21, as in the comparative example shown in FIG. 15, between the PDTL resonator 21 and the slot line 22, by providing an exciting slot portion 24 which has a width larger than that of the slot 22A, the amount of coupling between the PDTL resonator 21 and the slot line 22 can be also increased.

In this case, the exciting slot portion 24 is formed out of the PDTL resonator 21. Thus, an area for forming the exciting slot portion 24 in addition to the PDTL resonator 21 is required, thus causing a problem in that the entire device is enlarged.

Conversely, in the second embodiment, the excitation section 23 is formed in the PDTL resonator 21. Thus, an area for forming the excitation section 23 separately from the PDTL resonator 21 is not required, thus reducing the size of the entire device compared with the comparative example.

The second embodiment uses the PDTL resonator 21 as a resonator. However, the present invention is not limited thereto. In the present invention, a slot line resonator in which an electrode film 2 having a rectangular opening is formed on the front surface 1A of the dielectric substrate 1 and in which the electrode film 3 is omitted from the back surface 1B may be used as a resonator. Also, the present invention may use a slot line resonator with a grounded conductor, in which an electrode film 2 having a rectangular opening is formed on the front surface 1A of the dielectric substrate 1 and in which a grounded electrode film 2 is provided on all the back surface 1B.

The first embodiment uses, as a slot line, the PDTL 5 in which the slots 5A and 5B are respectively formed on the surfaces of the dielectric substrate 1, and the second embodiment uses, as a slot line, the slot line 22 in which the slot 22A is formed only on the front surface 1A of the dielectric substrate 1 and the grounded electrode film 3 is provided on the back surface 1B.

However, the present invention is not limited to these embodiments. The present invention may use a slot line in which a slot is formed only on the front surface 1A of the dielectric substrate 1 and the electrode film 3 is omitted from the back surface 1B.

Figure 16:
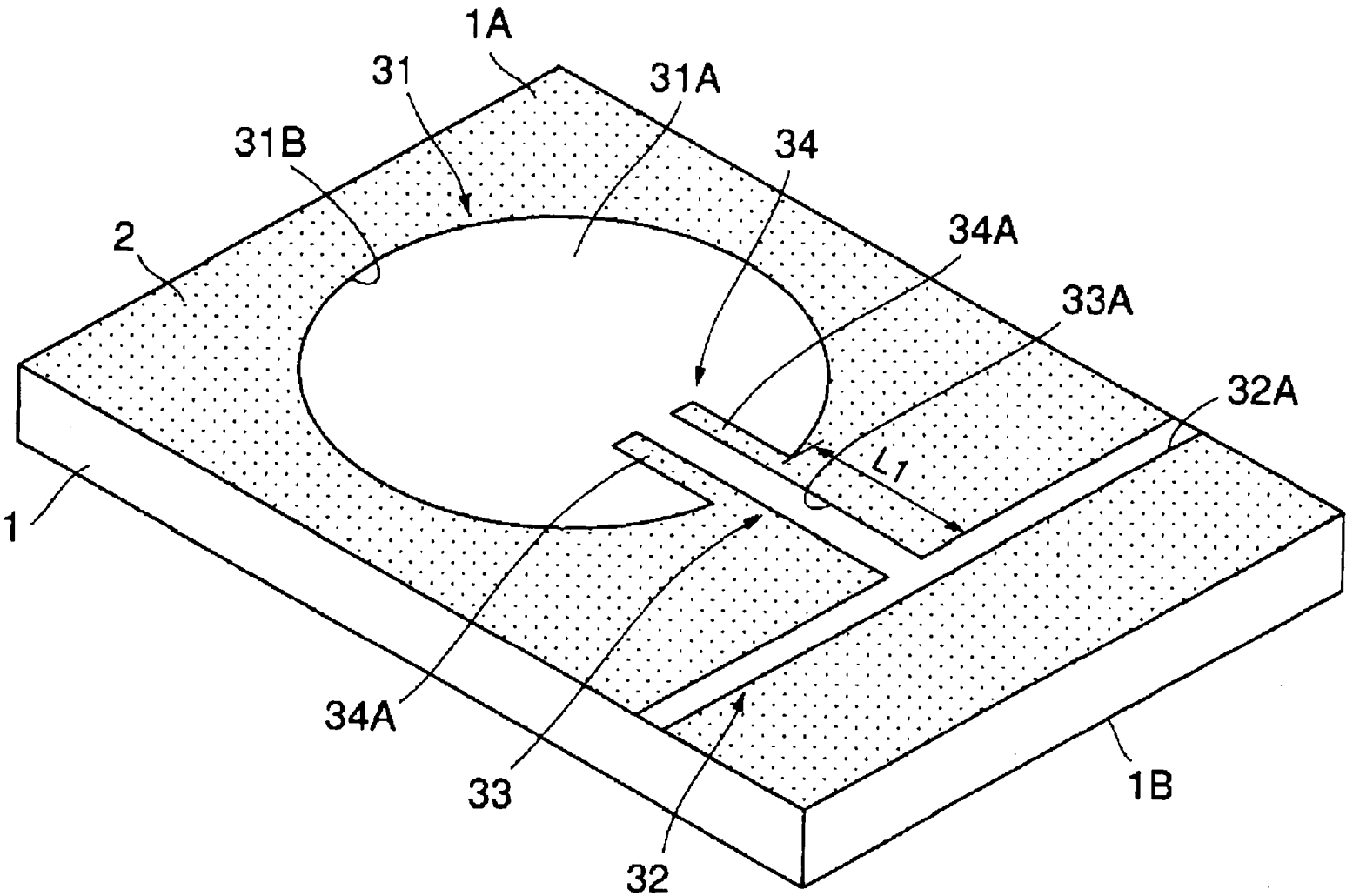
FIG. 16 is a perspective view showing a dielectric resonator device according to a third embodiment of the present invention.

Next, FIG. 16 shows a dielectric resonator device according to a third embodiment of the present invention. The third embodiment is characterized in that a stub line branching off from a transmission line is connected to a resonator and an excitation section is disposed at an end of the stub line. In the third embodiment, components identical to those in the first embodiment are denoted by identical reference numerals, and descriptions thereof are omitted.

A circular resonator 31 is provided in the center of the dielectric substrate 1. The circular resonator 31 is formed by a circular opening 31A formed in an electrode film 2. In the circular resonator 31, when the wavelength of a high frequency signal corresponding to resonant frequency f0 in the dielectric substrate 1 is represented by λg, the diameter is set to a value approximately equal to wavelength λg. In the third embodiment, no electrode film is formed on the back surface 1B of the dielectric substrate 1.

A slot line 32 (another type of slot line) is a transmission line provided away from the circular resonator 31. The slot line 32 is formed by a groove slot 32A formed in an electrode film 2. The slot 32A leads in parallel with a tangent to the slot 32A.

A stub line 33 is a T-branch line branching off in a T-form from the slot line 32. The stub line 33 linearly leads from a position on the slot line 32 to the circular resonator 31, and is formed along the direction of a normal to the circular resonator 31. The stub line 33 is formed by a groove slot 33A formed in the electrode film 2. The length L1 of the slot 33A forming the distance between the stub line 32 and the periphery of the 31B of the circular resonator 31 is set to a value of approximately λg/4(L1=λg/4), where the wavelength of a high frequency signal is represented by λg. The length L1 of the slot 33A may be set to a value of approximately (2n+1)×λg/4 (where n represents an integer) without being limited to the value of approximately λg/4(L1=λg/4).

An excitation section 34 is provided in the opening 31A of the circular resonator 31. The excitation section 34 leads to the center of the circular resonator 31, lying on a line extending from the stub line 33. The excitation section 34 is formed by drawing, into the opening 31A, two portions of the electrode film 2 which are on two sides of the stub line 33. The excitation section 34 is provided on the front surface 1A of the dielectric substrate 1, projecting in the opening 31A. The excitation section 34 is formed by two slender excitation lines 34A extending in parallel. The length by extension of the excitation section 34 is set to, for example, a value between λg/4 and (3×λg)/4.

Accordingly, also in the third embodiment, operation and advantages similar to those in the first embodiment can be obtained. In the third embodiment, the excitation section 34 is provided at the end of the stub line 33 branching off in a T-form from the slot line 32, and the circular resonator 31 and the stub line 33 are connected to each other. Thus, among high frequency signals transmitted through the slot line 32, a signal corresponding to resonant frequency f0 is reflected by the circular resonator 31. Therefore, the entire device forms a band-reflecting filter.

Also, the length L1 of the stub line 33 is set to approximately a value of λg/4. Thus, a base portion of the stub line 33 which branches off in a T-form can be used as a virtual open end, and an end of the stub line 33 can be used as a virtual short-circuited end. Also, an end of the excitation section 34 provided at the end of the stub line 33 can be used as a virtual open end. Accordingly, the end (open end) of the excitation section 34, which has strong electric field intensity, can be disposed in a position in the opening 31A which has strong electric field, thus further strengthening the coupling between the circular resonator 31 and the stub line 33.

In addition, the circular resonator 31, the slot line 32, the stub line 33, and the excitation section 34 can be formed together in a film-forming process for forming the electrode film 2. Thus, a dielectric resonator device having small differences in characteristics can be provided.

Figure 17:
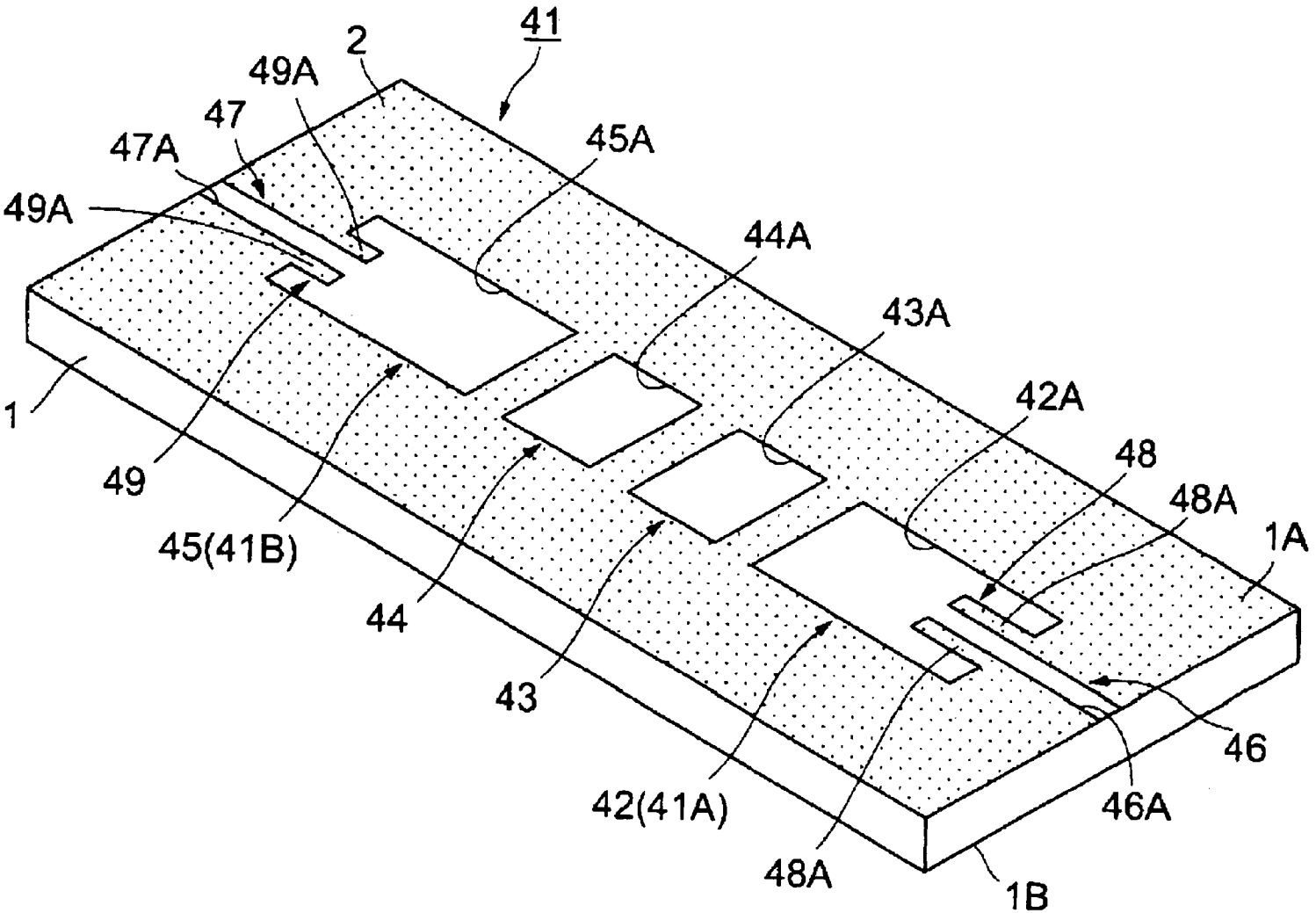
FIG. 17 is a perspective view showing a high frequency filter according to a fourth embodiment of the present invention.

Next, FIG. 17 shows a high frequency filter 41 according to a fourth embodiment of the present invention. The fourth embodiment is characterized in that the high frequency filter 41 is constituted by a plurality of slot line resonators and in that each of a slot line resonator as an input unit and a slot line resonator as an output unit includes an excitation section at an end of a slot line. In the fourth embodiment, components identical to those in the first embodiment are denoted by identical reference numerals, and descriptions thereof are omitted.

The high frequency filter 41 is constituted by four slot line resonators 42 to 45, etc., which are described later.

The slot line resonators 42 to 45 are linearly arranged on a front surface 1A of a dielectric substrate 1. The slot line resonators 42 to 45 are formed by quadrangle openings 42A to 45A formed on an electrode film 2. Among the slot line resonators 42 to 45, the slot line resonators 42 and 45 at two ends form an input unit 41A and an output unit 41B. In the fourth embodiment, no electrode film is formed on a back surface 1B of the dielectric substrate 1.

Slot lines 46 and 47 are connected to the input slot line resonator 42 and the output slot line resonator 45, respectively. The slot line resonators 46 and 47 linearly lead from the periphery of the dielectric substrate 1 to the slot line resonators 42 and 45, respectively. The slot line resonators 46 and 47 are formed by groove slots 46A and 47A formed on the electrode film 2.

Excitation sections 48 and 49 are respectively provided in openings 42A and 45A of the slot line resonators 42 and 45. The excitation sections 48 and 49 respectively lead to the centers of the slot line resonators 42 and 45, lying on lines extending from the slot lines 46 and 47. The excitation sections 48 and 49 are respectively formed by drawing, into the openings 42A and 45A, portions of the electrode film 2 on two sides of the slot lines 46 and 47. The excitation sections 48 and 49 respectively project into the openings 42A and 45A, and are formed by two pairs of slender excitation lines 48A and 49A extending in parallel.

The high frequency filter 41 according to the fourth embodiment has the above-described structure. High frequency signals input to the slot line 46 are supplied into the slot line resonator 42 through the excitation section 48. At this time, the slot line resonator 42 excites a high frequency signal in accordance with its resonant frequency, and combines with the adjacent slot line resonator 43 to excite a high frequency signal in accordance with its resonant frequency. Among the slot line resonators 42 to 44, two adjacent resonators are coupled with each other. Thus, among the high frequency signals, only signals in accordance with the resonant frequencies of the slot line resonators 42 to 44 are transmitted to the output slot line resonator 45, and are output from the slot line 47 through the excitation section 49. This allows the high frequency filter to operate as a band-pass filter.

Accordingly, the fourth embodiment can obtain operation and advantages similar to those in the first embodiment. However, in the fourth embodiment, the slot line resonators 42 and 45 in which the input unit 41A and the output unit 41B of the high frequency filter 41 are respectively provided with the excitation sections 48 and 49 are used. Thus, the coupling between each of the slot line resonators 42 and 45 and each of the slot lines 46 and 47 can be strengthened, thus enabling an expanded frequency band of the high frequency filter 41 compared with a case in which the excitation sections 48 and 49 are not used.

Although in the fourth embodiment the slot line resonators 42 and 45 respectively provided with the excitation sections 48 and 49 are used as the input unit 41A and output unit 41B of the demultiplexer 41, a slot line resonator provided with an excitation section may be used as either an input unit or an output unit so that the other excitation section can be omitted.

Figure 18:
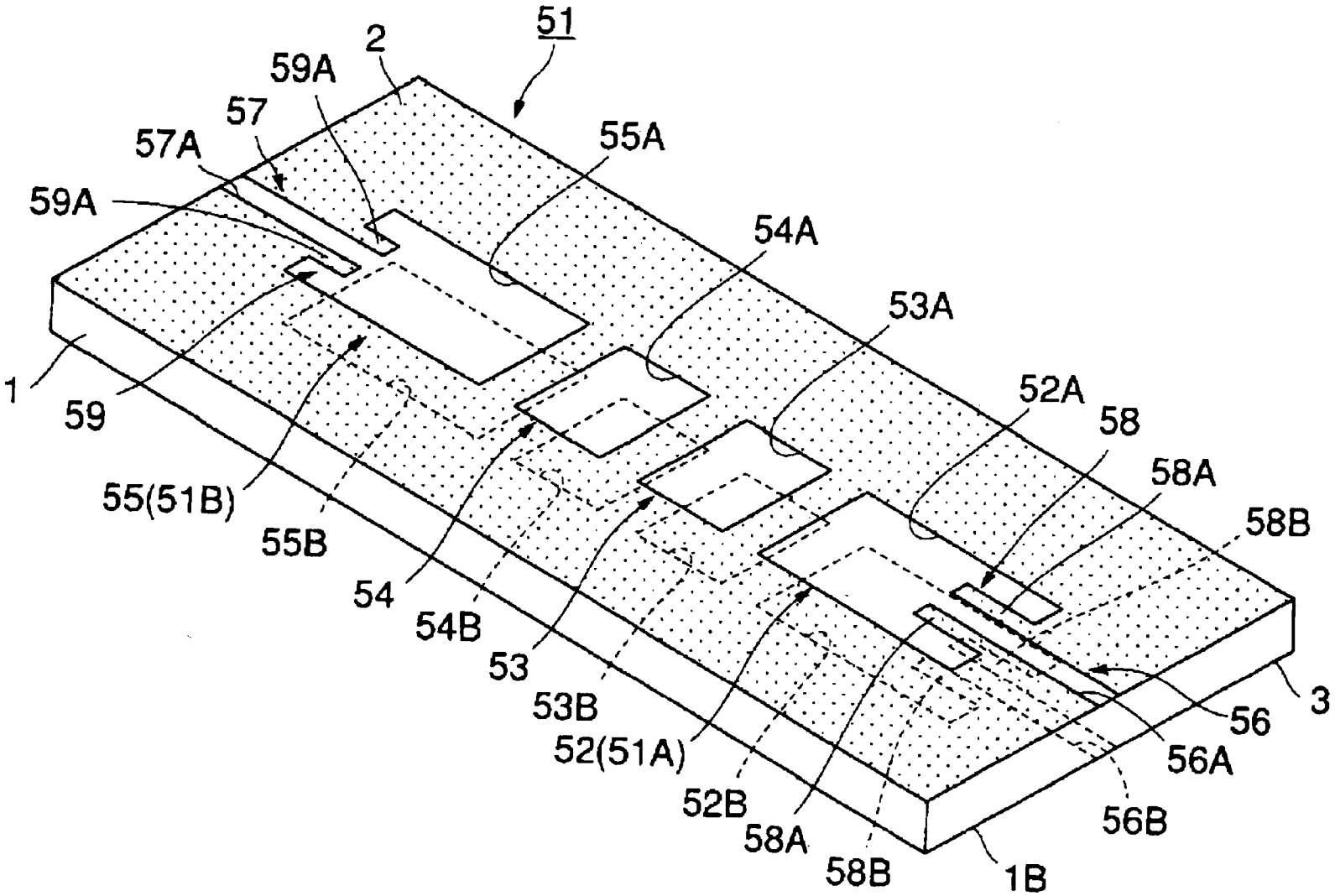
FIG. 18 is a perspective view showing a high frequency filter according to a fifth embodiment of the present invention.

Next, FIG. 18 shows a high frequency filter 51 according to a fifth embodiment of the present invention. The fifth embodiment is characterized in that slot line resonators forming the input and output units of the high frequency filter 51 are respectively provided with excitation sections and in that different types of slot lines are connected to the input and output units. In the fifth embodiment, components identical to those in the first embodiment are denoted by identical reference numerals, and descriptions thereof are omitted.

The high frequency filter 51 includes four PDTL resonators 52 to 55, which are described later.

The PDTL resonators 52 to 55 are linearly arranged on a surface 1A of a dielectric substrate 1. The PDTL resonators 52 to 55 consist of quadrangle openings 52A to 55A formed in an electrode film 2, and quadrangle openings 52B to 55B formed in an electrode film 3 so as to oppose the openings 52A to 55A. Among the PDTL resonators 52 to 55, the PDTL resonators 52 and 55 at ends of the high frequency filter 51 form an input unit 51A and output unit 51B of the high frequency filter 51, respectively.

A PDTL 56 is connected as a slot line to the input PDTL resonator 52. The PDTL 56 linearly leads from a peripheral edge of the dielectric substrate 1 to the PDTL resonator 52. The PDTL resonator 52 consists of a groove slot 56A formed in the electrode film 2 and a slot 56B formed on the electrode film 3 so as to oppose the slot 56A.

A slot line 57 with a grounded conductor differs in type from the PDTL 56 connected to the PDTL resonator 55. The slot line 57 linearly leads from a peripheral edge of the dielectric substrate 1 to the PDTL resonator 55, and is formed by a groove slot 57A formed on the electrode film 2. The electrode film 3 formed on the back surface 1B of the dielectric substrate 1 is grounded.

An excitation section 58 is provided in the openings 52A and 52B of the PDTL resonator 52. The excitation section 58 leads to the center of the PDTL resonator 52, lying on a line extending from the PDTL 56. The excitation section 58 is formed by drawing, into the openings 52A and 52B, two portions of each of the electrode films 2 and 3 on two sides of the PDTL 56. The excitation section 58 is constituted by two slender excitation lines 58A extending in parallel in a form projecting into the opening 52A, and two excitation lines 58B which oppose the excitation lines 58A and which project into the opening 52B.

An excitation section 59 is provided in the opening 55A of the PDTL resonator 55. The excitation section 59 leads to the center of the PDTL resonator 55, lying on a line extending from the slot line 57. The excitation section 59 is formed by drawing, into the opening 55A, two portions of the electrode film 2 on two sides of the slot line 57. The excitation section 59 projects into the opening 55A, and is constituted by two slender excitation lines 59A extending in parallel.

The high frequency filter 51 according to the fifth embodiment has the above structure, and operates as a band-pass filter similarly to the fourth embodiment.

Accordingly, also the fifth embodiment can obtain operation and advantages similar to those in the first embodiment. In the fifth embodiment, the PDTL resonators 52 and 55 respectively provided with the excitation sections 58 and 59 are used as the input unit 51A and output unit 51B of the high frequency filter 51. Thus, the coupling between each of the PDTL resonators 52 and 55 and each of the PDTL 56 and the slot line 57 can be strengthened, thus enabling an expanded frequency range of the high frequency filter 51.

In the fifth embodiment, the PDTL 56 and the slot line 56 are respectively connected as different types of slot lines to the input unit 51A and output unit 51B of the high frequency filter 51. This builds a line conversion function into the high frequency filter 51, thus making the high frequency filter 51 highly functional. Also, the structure required for the line conversion does not need to be separately provided, thus reducing the size of the entire device.

In the fifth embodiment, the PDTL 56 and the slot line 57 are used as a slot type line. However, the present invention is not limited thereto. For example, instead of one of the PDTL 56 and the slot line 57, a slot line with no grounded conductor used may be used.

Figure 19:
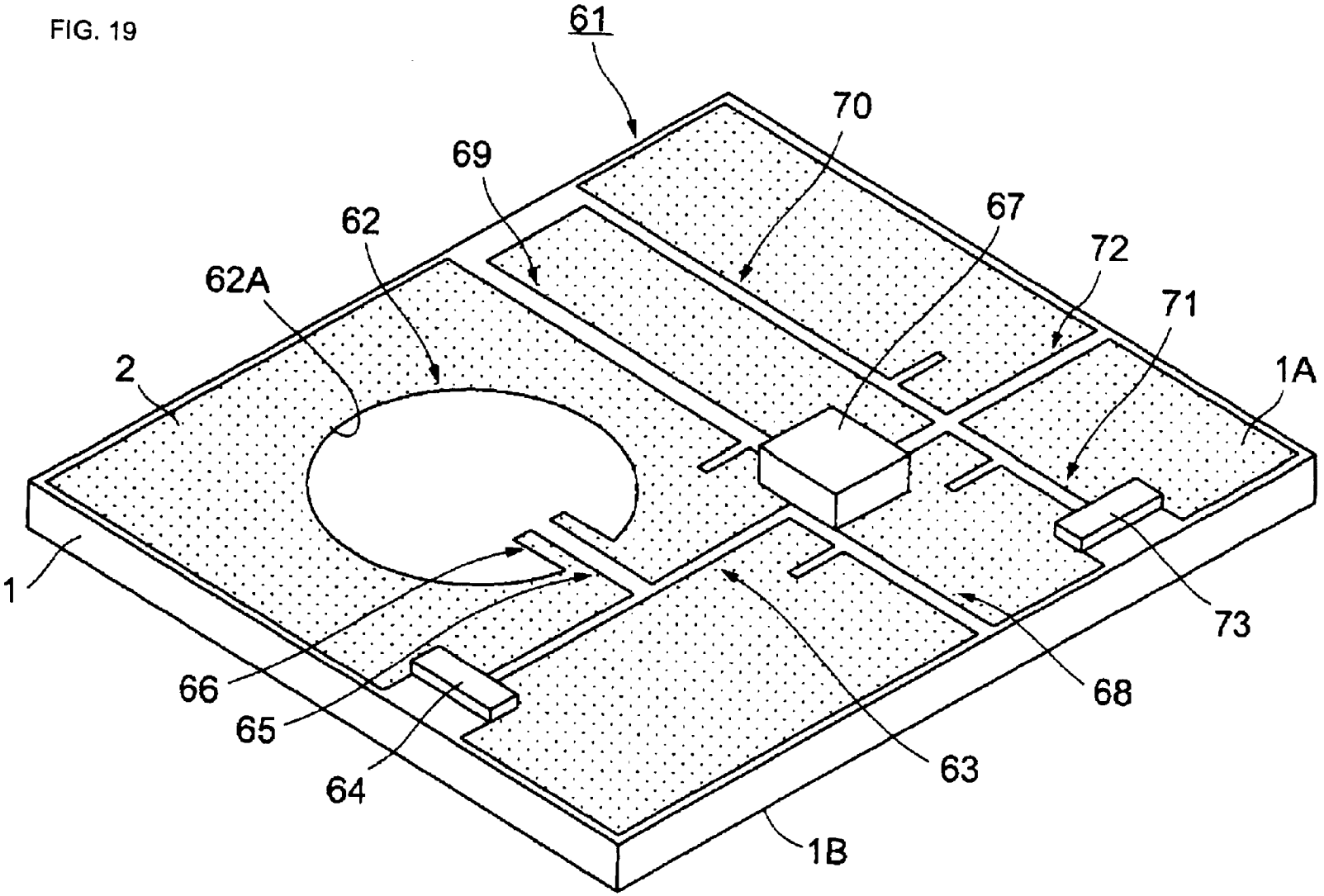
FIG. 19 is a perspective view showing a high frequency filter according to a sixth embodiment of the present invention.

Next, FIG. 19 shows a high frequency oscillator 61 according to a sixth embodiment of the present invention. The sixth embodiment is characterized in that the high frequency oscillator 61 includes a circular resonator provided with an excitation section. In the sixth embodiment, components identical to those in the first embodiment are denoted by identical reference numerals, and descriptions thereof are omitted.

The high frequency oscillator 61 includes a circular resonator 62 and a field effect transistor (FET) 67, which are described below.

The circular resonator 62 is provided on a dielectric substrate 1. The circular resonator 62 is formed by a circular opening 62A formed on an electrode film 2. The circular resonator 62 has a diameter approximately equal to wavelength $\lambda g$ when the wavelength of a high frequency signal corresponding to resonant frequency f0 in the dielectric substrate 1 is represented by $\lambda g$. In the sixth embodiment, no electrode film is formed on a back surface 1B of the dielectric substrate 1.

A slot line 63 (another slot type line) is provided as a transmission line away from the circular resonator 62. The slot line 63 has a base end connected to the gate terminal of the FET 67, which is described later, and a leading end connected to a terminating resistor 64.

A stub line 65 is a T-branch line which branches off from the slot line 63 in a T-form. The stub line 65 linearly leads from a position on the slot line 65 to the circular resonator 62, and is formed along the direction of a normal to the circular resonator 62. The length of the stub line 65 is set to be a value of approximately λg/4 when the wavelength of the high frequency signal is represented by λg.

An excitation section 66 is provided projecting into the opening 62A of the circular resonator 62. The excitation section 66 is formed by drawing, into the opening 62A, two portions of the electrode film 2 on two sides of the stub line 65. The excitation section 66 leads to the center of the circular resonator 62, lying on a line extending from the stub line 65.

A FET 67 is provided at the base end of the slot line 63. The FET 67 has a gate terminal connected to the slot line 63, and a DC-cut circuit 68 for eliminating a biasing direct current component is connected to the FET 67. A feedback circuit 69 is connected across the gate terminal and drain terminal of the FET 67. A DC-cut circuit 70 for eliminating a biasing direct current component, a damping circuit 71, and a slot line 72 are connected to the drain terminal of the FET 67. The source terminal of the FET 67 is grounded.

The damping circuit 71 has a base end connected to the drain terminal of the FET 67 and a leading end connected to a terminating resistor 73. The slot line 72 forms an output terminal and outputs, to the exterior, high frequency signals generated by the high frequency oscillator 61.

The high frequency oscillator 61 has the above structure. The circular resonator 62, the slot line 63, the stub line 65, etc., operate as a band reflecting filter, and input, to the FET 67, a high frequency signal according to the resonant frequency. At this time, the FET 67 uses the feedback circuit 69 to amplify the high frequency signal and outputs the amplified signal from the slot line 72. This allows the high frequency oscillator 61 to operate on the whole as a stabilizing oscillator circuit for improving phase noise.

Accordingly, also the sixth embodiment can obtain operation and advantages similar to those in the first embodiment. However, in the sixth embodiment, the high frequency oscillator 61 is formed by using the circular resonator 62 provided with the excitation section 66. Thus, the coupling between the circular resonator 62 and the stub line 65 can be strengthened, thus enabling an increased frequency modulation width and increased oscillation output of the high frequency oscillator 61. In addition, because the strong coupling is established, preventing Q0 from deteriorating, the load Q (QL) of the circular resonator 62 can be increased and the phase noise can be reduced.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric resonator device comprising:

a dielectric substrate;

an electrode film provided on a surface of said dielectric substrate, said electrode film including an opening; and a slot formed in said electrode film, the slot being connected to the opening, wherein said electrode film includes an excitation section formed by extending two portions of said electrode film on two sides of said slot into said opening, leading ends of said two portions of said excitation section are one of short-circuit ends or open circuit ends, and a length of said two portions of said excitation section is set to substantially a value between λg/4 and (3×λg)/4, where λg represents the wavelength of a high frequency signal used in said dielectric substrate.

2. The dielectric resonator device according to claim 1, wherein a distance between respective leading ends of said two portions of said excitation section is different than a distance between respective base ends thereof.

3. The dielectric resonator device according to claim 1, wherein a transmission line for transmitting a high frequency signal is provided on said surface of said dielectric substrate, said slot line forms a T-branch line which branches from said transmission line, and said excitation section is disposed at a leading end of said T-branch line.

4. The dielectric resonator device according to claim 3, wherein a length of said T-branch line is set to substantially a value of λg/4, where λg represents the wavelength of the high frequency signal used in said dielectric substrate.

5. The dielectric resonator device according to claim 1, wherein leading ends and base ends of said two portions of said excitation section are formed as continuous rounded portions.

6. The dielectric resonator device according to claim 1, wherein said opening is circular.

7. The dielectric resonator device according to claim 6, wherein each of said two portions of said excitation section include a respective segment which extend in mutually opposite directions to each other.

8. The dielectric resonator device according to claim 7, wherein said respective segments extend along a circumference of said opening.

9. The dielectric resonator device according to claim 1, wherein each of said two portions of said excitation section include a respective segment which extend in mutually opposite directions to each other.

10. The dielectric resonator device according to claim 1, wherein a leading end of said two portions of said excitation section has a different thickness than a base end thereof.

11. A frequency oscillator comprising:

a dielectric resonator device which includes:

a dielectric substrate;

an electrode film provided on a surface of said dielectric substrate, said electrode film including an opening; and a slot formed in said electrode film, the slot being connected to the opening, wherein said electrode film includes an excitation section formed by extending two portions of said electrode film on two sides of said slot into said opening, leading ends of said two portions of said excitation section are one of short-circuit ends or open circuit ends, and a length of said two portions of said excitation section is set to substantially a value between λg/4 and (3×λg)/4, where λg represents the wavelength of a high frequency signal used in said dielectric substrate.

12. A frequency filter comprising:

an input unit; and an output unit coupled to said input unit, wherein at least one of said input unit and said output unit is a dielectric resonator device which includes:

a dielectric substrate;

an electrode film provided on a surface of said dielectric substrate, said electrode film including an opening; and a slot formed in said electrode film, the slot being connected to the opening, wherein said electrode film includes an excitation section formed by extending two portions of said electrode film on two sides of said slot into said opening.

13. The high frequency filter according to claim 12, wherein a slot line is connected to the output unit to establish line conversion, said slot line of said output unit being different from a slot line connected to said input unit.

14. A dielectric resonator device comprising:

a dielectric substrate;

an electrode film provided on a surface of said dielectric substrate, said electrode film including an opening; and a slot formed in said electrode film, the slot being connected to the opening, wherein said electrode film includes an excitation section formed by extending two portions of said electrode film on two sides of said slot into said opening, wherein said leading ends of said two portions of said excitation section are short-circuited by connecting said leading ends together.

* * * * *